US009309817B2

(12) United States Patent
Yoshida et al.

(10) Patent No.: US 9,309,817 B2
(45) Date of Patent: Apr. 12, 2016

(54) FUEL CUT CONTROL DEVICE AND FUEL CUT CONTROL METHOD FOR INTERNAL COMBUSTION ENGINE

(71) Applicant: NISSAN MOTOR CO., LTD., Yokohama-shi, Kanagawa (JP)

(72) Inventors: Marie Yoshida, Yamato (JP); Tamikazu Kimura, Atsugi (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 14/356,439

(22) PCT Filed: Oct. 3, 2012

(86) PCT No.: PCT/JP2012/075619

§ 371 (c)(1),
(2) Date: May 6, 2014

(87) PCT Pub. No.: WO2013/080655

PCT Pub. Date: Jun. 6, 2013

(65) Prior Publication Data

US 2014/0318496 A1 Oct. 30, 2014

(30) Foreign Application Priority Data

Nov. 28, 2011 (JP) ..... 2011-258391

(51) Int. Cl.
*F02M 63/02* (2006.01)
*F02D 17/02* (2006.01)
(Continued)

(52) U.S. Cl.
CPC *F02D 17/02* (2013.01); *F01N 3/10* (2013.01); *F01N 3/20* (2013.01); *F02D 41/0087* (2013.01);
(Continued)

(58) Field of Classification Search
CPC ..... F02D 41/0087; F02D 41/123; F02D 2250/21; F02D 37/02; F02D 41/1454; F02D 41/008; F02D 41/0295
USPC ..... 123/332; 701/102–104; 477/177
See application file for complete search history.

(56) References Cited

U.S. PATENT DOCUMENTS 5,816,353 A 10/1998 Matsuki
5,941,212 A * 8/1999 Murakami et al. ..... 123/325
(Continued)

FOREIGN PATENT DOCUMENTS

JP S61-23843 A 2/1986
JP H04-098658 A 10/1992
(Continued)

*Primary Examiner* — Marguerite McMahon
*Assistant Examiner* — James Kim
(74) *Attorney, Agent, or Firm* — Drinker Biddle & Reath LLP

(57) ABSTRACT

The objective of the present invention is to prevent an increase in the amount of oxygen stored in a catalyst due to a fuel cut by performing a rich spike, even when the fuel is again supplied after a fuel cut in some of the cylinders. When a prescribed fuel cut condition has been satisfied (t1, t6), first, the fuel to some of the cylinders is cut, and after a prescribed period of time (A1) has elapsed, the supply of fuel to all of the cylinders is cut (A2). When the fuel to only some of the cylinders has been cut and a prescribed fuel cut recovery condition has been satisfied (t3), fuel is again supplied to the aforementioned cylinders, and during a prescribed period (C1) after the supply of the fuel has been restarted a rich spike (D1) is executed, whereby the amount of fuel being supplied is increased and the exhaust air-fuel ratio is controlled so as to be richer than the stoichiometric air-fuel ratio.

10 Claims, 3 Drawing Sheets

(51) Int. Cl.

| | |
|---|---|
| ***F02D 41/12*** | (2006.01) |
| ***F01N 3/10*** | (2006.01) |
| ***F02D 41/00*** | (2006.01) |
| ***F02D 41/02*** | (2006.01) |
| ***F01N 3/20*** | (2006.01) |
| *F02D 37/02* | (2006.01) |

(52) U.S. Cl.
CPC ..... *F02D 41/0295* (2013.01); *F02D 41/123* (2013.01); *F02D 41/126* (2013.01); *F02D 37/02* (2013.01)

(56) References Cited

U.S. PATENT DOCUMENTS 7,028,670 B2 * 4/2006 Doering ..... 123/481
7,357,109 B2 * 4/2008 Mitsuhori ..... F02D 37/02 123/179.18
2006/0046896 A1 * 3/2006 Nakajima ..... B60W 10/06 477/107
2010/0191439 A1 * 7/2010 Fabien ..... B60W 10/06 701/103
2011/0130902 A1 * 6/2011 Heisel ..... B60K 6/485 701/22
2011/0251756 A1 * 10/2011 Major ..... F02D 17/02 701/36
2011/0270509 A1 * 11/2011 Whitney ..... F02D 13/0219 701/103
2012/0055444 A1 * 3/2012 Tobergte ..... F02D 13/06 123/294
2013/0179051 A1 * 7/2013 Tomimatsu ..... F02D 17/02 701/104
2014/0039778 A1 * 2/2014 Kerns et al. ..... 701/103

FOREIGN PATENT DOCUMENTS

JP H09-112308 A 4/1997
JP 2006-118433 A 5/2006
JP 2006-275003 A 10/2006
JP 2007-278224 A 10/2007

* cited by examiner

FUEL CUT CONTROL DEVICE AND FUEL CUT CONTROL METHOD FOR INTERNAL COMBUSTION ENGINE

TECHNICAL FIELD

The present invention relates to internal combustion engine fuel cut control.

BACKGROUND ART

In an internal combustion engine mounted on a vehicle, fuel cut is performed to enhance fuel efficiency when the vehicle is decelerating. A patent document 1 discloses a technique to implement such a fuel cut by first cutting off fuel to part of cylinders, and then cutting off fuel to all of the cylinders, and thereby suppress a torque discontinuous change resulting from the fuel cut, while enhancing combustion stability by concentrating fuel to part of the cylinders by the fuel cut of part of the cylinders.

PRIOR ART DOCUMENT(S)

Patent Document(s)

Patent Document 1: JP H04-298658

SUMMARY OF THE INVENTION

Problem(s) to be Solved by the Invention

During a fuel cut, exhaust gas high in oxygen concentration (or air) is supplied to an exhaust passage, so that a stored amount of oxygen in a catalyst gradually increases, wherein the catalyst is disposed in the exhaust passage for exhaust gas purification. Accordingly, if the fuel cut is terminated and fuel supply is simply restarted when a fuel cut recovery condition based on driver's accelerator pedal depression or the like is satisfied while the fuel cut is being performed for part of cylinders, it is possible that the stored amount of oxygen becomes excessively large to adversely affect the nominal purifying function of the catalyst.

Means for Solving the Problem(s)

Accordingly, the present invention is configured to perform the following: performing a first operation of cutting off fuel supply to part of the cylinders in response to satisfaction of a predetermined fuel cut condition, and performing a second operation of cutting off fuel supply to all of the cylinders in response to a lapse of a first predetermined time period after the first operation; and performing a third operation and a fourth operation in response to satisfaction of a first predetermined fuel cut recovery condition during the first operation, wherein the third operation is to restart fuel supply to the part of the cylinders, and the fourth operation is to control exhaust gas to a first air fuel ratio richer than a theoretical air fuel ratio by an increased amount of fuel supply during a second predetermined time period after the third operation.

Effect(s) of the Invention

According to the present invention, the feature of increasing the amount of fuel supply during the second predetermined time period after the restart of fuel supply even when fuel supply is restarted by terminating the fuel cut in response to the satisfaction of the fuel cut recovery condition while the fuel cut is being performed only for part of the cylinders, serves to reduce the stored amount of oxygen in the catalyst increased by the fuel cut, and thereby solve the problem that the stored amount of oxygen in the catalyst is increased excessively by the fuel cut.

MODE(S) FOR CARRYING OUT THE INVENTION

Figure 1:
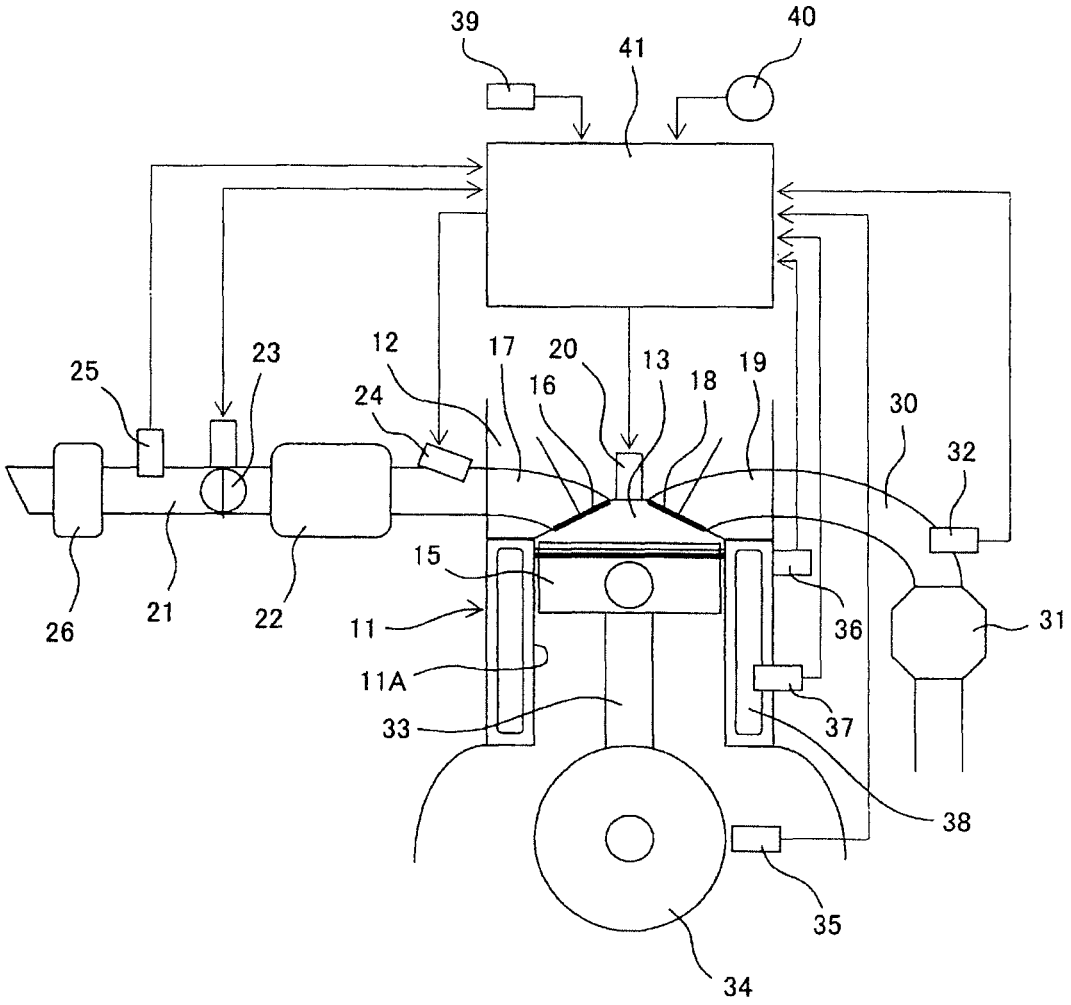
FIG. 1 is a diagram showing configuration of an internal combustion engine according to an embodiment of the present invention.

The following describes a preferable embodiment of the present invention with reference to the drawings. FIG. 1 is a diagram showing system configuration of a port-injection spark-ignition type gasoline engine according to the embodiment of the present invention. An internal combustion engine 10 includes a cylinder block 11 and a cylinder head 12, wherein cylinder block 11 is formed with a plurality of cylinders (bores) 11A, and cylinder head 12 is fixed to an upper side of cylinder block 11. Although FIG. 1 specifically shows only one cylinder 11A, the plurality of cylinders 11A are arranged in a cylinder row direction.

Each cylinder 11A is provided with a piston 15 slidably therein, wherein a combustion chamber 13 is defined between an upper side of piston 15 and an underside of cylinder head 12 having a pent roof shape. Each combustion chamber 13 is connected to an intake port 17 through an intake valve 16, and is connected to an exhaust port 19 through an exhaust valve 18. In combustion chamber 13 is provided an ignition plug 20 at the center of the top side, wherein ignition plug 20 ignites a mixture by a spark.

Intake port 17 of each cylinder is connected to an intake passage 21 in which an electrically-controlled throttle valve 23 and a fuel injection valve 24, wherein so throttle valve 23 is disposed on an upstream side of an intake collector 22 and adjusts the amount of intake air, and fuel injection valve 24 injects fuel to intake port 17. It is not limited to such a port injection type, but may be of an in-cylinder direct injection type that injects directly fuel into a combustion chamber. An air flow meter 25 and an air cleaner 26 are provided on an upstream side of throttle valve 23, wherein air flow meter 25 senses the amount of intake air, and air cleaner 26 traps foreign objects in intake air.

Exhaust port 19 of each cylinder is connected and collected to an exhaust passage 30, in which a catalyst 31 such as a three-way catalyst is disposed. An air fuel ratio sensor 32 such as an oxygen concentration sensor is provided on an upstream side of catalyst 31, and senses the air fuel ratio of exhaust gas. An air fuel ratio feedback control that increases and reduces the amount of fuel injection to hold the air fuel ratio of exhaust gas at a target air fuel ratio (theoretical air fuel ratio) based on a sensing signal of air fuel ratio sensor 32.

Piston 15 of each cylinder is linked to a crankshaft 34 through a connecting rod 33. A crank angle sensor 35 is provided at cylinder block 11 for sensing the crank angle of crankshaft 34. Moreover, a knock sensor 36 is provided at cylinder block 11 for detecting vibration of the internal combustion engine.

In addition to the sensors described above, various sensors and switches are provided for sensing engine operating condition, which include a water temperature sensor 37 for sensing the temperature of cooling water in a water jacket 38, an accelerator opening sensor 39 for sensing accelerator opening APO of an accelerator pedal operated by a driver, and an ignition switch 40 for start and stop of the internal combustion engine.

An engine control unit (ECU) 41 as a control means includes a microcomputer having a function of memorizing and executing various control operations. ECU 41 outputs control signals to throttle valve 23, ignition plug 20, fuel injection valve 24, etc., based on input signals from the sensors and switches, and thereby controls operations thereof.

Figure 2:
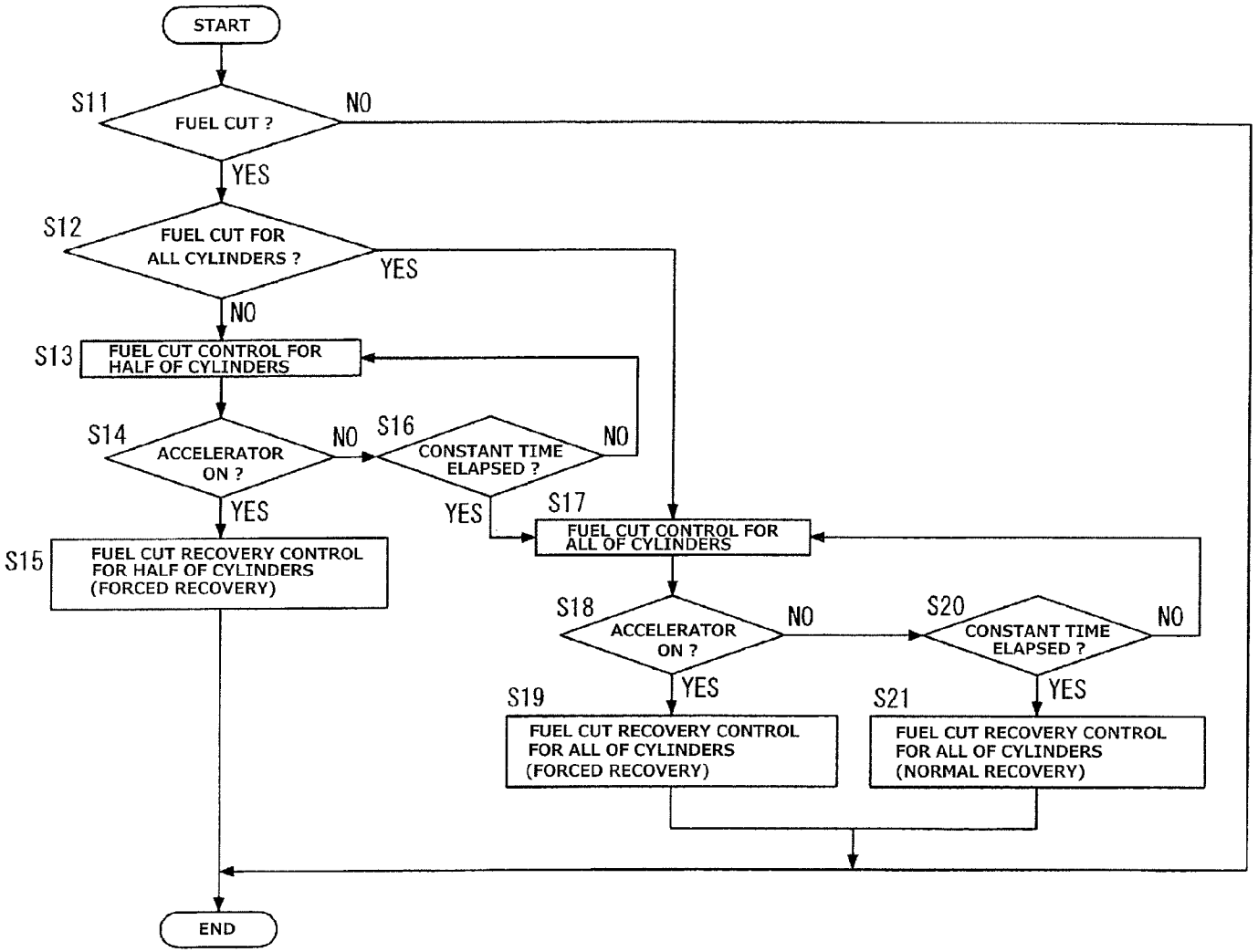
FIG. 2 is a flow chart showing a flow of fuel cut control according to the present embodiment.

FIG. 2 is a flow chart showing a flow of fuel cut control and fuel cut recovery control according to the present embodiment. This routine is memorized and executed by ECU 41.

At Step S11, ECU 41 determines whether or not a predetermined fuel cut condition is satisfied, namely, whether or not it is in a decelerating state where fuel cut is performed. For example, when accelerator opening APO is equal to zero (accelerator OFF) and the vehicle speed is greater than or equal to a constant value, ECU 41 determines that the fuel cut condition is satisfied. When the fuel cut condition is unsatisfied, ECU 41 terminates this routine. When the fuel cut condition is satisfied, ECU 41 proceeds to Step S12.

At Step S12, ECU 41 determines whether to perform an all-of-cylinders fuel cut to cut off fuel supply to all of the cylinders or to perform a half-of-cylinders fuel cut (or part-of-cylinders fuel cut) to cut off fuel supply to half of the cylinders (or part of the cylinders), based on the engine operating condition. Specifically, ECU 41 estimates a torque discontinuous change caused by the all-of-cylinders fuel cut, based on the vehicle speed and the engine rotational speed. When the torque discontinuous change is within an allowable region, ECU 41 proceeds to the all-of-cylinders fuel cut without performing the half-of-cylinders fuel cut. On the other hand, when the torque discontinuous change is out of the allowable region, ECU 41 performs the half-of-cylinders fuel cut, to suppress the torque discontinuous change resulting from the fuel cut. Although the number of cylinders for which the part-of-cylinders fuel cut is targeted is half of the number of all of the cylinders in this embodiment, it is not so limited but may be another number of cylinders.

When it is determined to perform the all-of-cylinders fuel cut at Step S12, ECU 41 proceeds to Step S17 where ECU 41 performs the all-of-cylinders fuel cut to stop fuel supply to all of the cylinders. On the other hand, when it is not determined to perform the all-of-cylinders fuel cut at Step S12, ECU 41 proceeds to Step S13 where ECU 41 performs the half-of-cylinders fuel cut. Namely, ECU 41 performs fuel supply to only half (or part) of the cylinders and cuts off fuel supply to the remaining half of the cylinders.

At Step S14, ECU 41 determines whether or not a predetermined fuel cut recovery condition is satisfied. Specifically, when the accelerator pedal is depressed (accelerator ON), ECU 41 determines that the fuel cut recovery condition is satisfied, based on accelerator opening APO and others, and proceeds to Step S15. At Step S15, ECU 41 performs a recovery control (forced recovery) from the half-of-cylinders fuel cut. Namely, ECU 41 forces a restart of fuel supply to the half of the cylinders to which fuel supply is stopped. The fuel cut recovery condition may be based on combination of the accelerator-ON condition described above and another condition such as a condition where the vehicle speed decreases below a predetermined value.

When the fuel cut recovery condition is unsatisfied at Step S14, ECU 41 proceeds to Step S16 where ECU 41 determines whether or not a constant time period A1 (see FIG. 3) has elapsed after the half-of-cylinders fuel cut is started. The constant time period A1 is a preset constant value in this example, but may be configured to be adjusted depending on the engine rotational speed, vehicle speed, etc., at the start of the fuel cut. When an action time period in which the half-of-cylinders fuel cut is performed has reached the constant time period A1, ECU 41 proceeds from Step S16 to Step S17 where ECU 41 performs the all-of-cylinders fuel cut. Namely, when the constant time period A1 has elapsed after the half-of-cylinders fuel cut is started, ECU 41 stops fuel supply to the remaining half of the cylinders to which fuel supply has been maintained, and thereby shifts into the all-of-cylinders fuel cut. At this moment, no excessive torque discontinuous change occurs, because the half-of-cylinders fuel cut has been performed so that the torque has fallen to some extent.

At the following Step S18, similar to Step S14, ECU 41 determines whether or not a predetermined fuel cut recovery condition is satisfied, specifically, whether or not depression of the accelerator pedal (accelerator ON) is detected. When the fuel cut recovery condition is satisfied, ECU 41 proceeds from Step S18 to Step S19. At Step S19, ECU 41 performs a recovery control (forced recovery) from the all-of-cylinders fuel cut. Namely, ECU 41 forces a restart of fuel supply to all of the cylinders to which fuel supply has been stopped.

When the fuel cut recovery condition is unsatisfied at Step S18, ECU 41 proceeds to Step S20 where ECU 41 determines whether or not a constant time period has elapsed after the all-of-cylinders fuel cut is started. When the constant time period has elapsed, ECU 41 proceeds from Step S20 to Step S21 where ECU 41 performs a recovery control (normal recovery) from the all-of-cylinders fuel cut. Namely, similar to the forced recovery control, ECU 41 restarts fuel supply to all of the cylinders to which fuel supply has been stopped.

Figure 3:
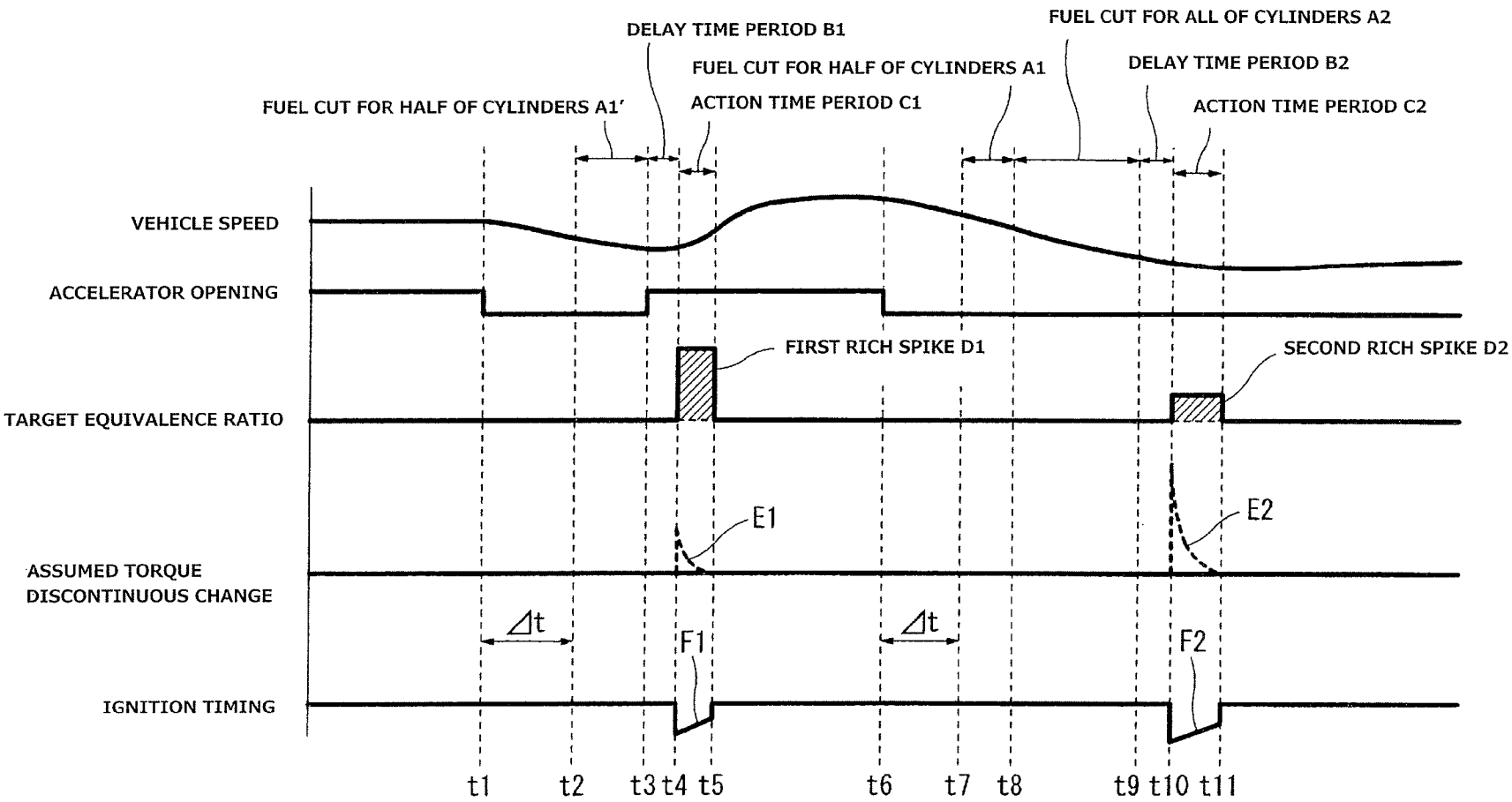
FIG. 3 is a timing chart showing changes of variables according to the control of the present embodiment.

FIG. 3 is a timing chart showing changes of variables according to the control of the present embodiment. At a time instant t1, the accelerator is turned off (accelerator opening APO becomes zero). At a time instant t2 when a predetermined time period Δt has elapsed after a shift into vehicle decelerating condition, the fuel cut condition is satisfied and the fuel cut is started. Although the fuel cut is stared at time instant t2 when the predetermined time period Δt has elapsed after time instant t1 of the shift into vehicle decelerating condition in order to avoid a rapid torque change in this example, it may be modified so that the fuel cut is started immediately after time instant t1 of the shift into vehicle decelerating condition.

In this example, at the fuel cut start time instant t2, the half-of-cylinders fuel cut is first performed because the estimated torque discontinuous change is out of the allowable region. At a time instant t3 while the half-of-cylinders fuel cut is being performed, the accelerator pedal is depressed by a driver to turn the accelerator ON before the constant time period A1 has elapsed. Accordingly, ECU 41 proceeds from Step S14 to Step S15 in FIG. 2 where the recovery control from the half-of-cylinders fuel cut is started, thereby restarting fuel supply. Although it appears in FIG. 3 that the time period A1' from time instant t2 to time instant t3 is greater than the constant time period A1, they are actually in the relationship of A1'<A1.

By performing the fuel cut, air having a high concentration of oxygen passes through catalyst 31, and thereby increases the stored amount of oxygen absorbed and stored in catalyst 31. Accordingly, during the recovery control from the half-of-cylinders fuel cut, a first rich spike D1 is performed by temporarily increasing the amount of fuel injection, to reduce the stored amount of oxygen in catalyst 31.

The first rich spike D1 is started at a time instant when the fuel cut is terminated, namely, at a time instant t4 when a predetermined delay time period B1 has elapsed after fuel supply restart time instant t3, and is continued only during a predetermined action time period C1. The first rich spike D1 is implemented by increasing the amount of fuel supply greater than a desired value corresponding to a desired equivalence ratio so that the air fuel ratio of exhaust gas becomes richer than the theoretical air fuel ratio. Namely, immediately after fuel supply restart time instant t3, a fuel injection control for engine restart is permed without the rich spike control in consideration of combustion stability, and then after the predetermined delay time period B1 has elapsed so that the combustion has been stabilized, the first rich spike D1 to increase the amount of fuel supply is started.

The amount of increase of fuel and the action time period C1 of the first rich spike D1 are set based on the engine rotational speed at the recovery start time instant t3 (or at the rich spike start time instant t4), and set so that the amount of increase increases (the degree of becomes rich) as the engine rotational speed increases, in conformance with the stored amount of oxygen absorbed and stored in catalyst 31. For a second rich spike D2 after the all-of-cylinders fuel cut, which is described below, the amount of increase of fuel is set based on the stored amount of oxygen. In contrast, for the first rich spike D1 after the half-of-cylinders fuel cut, the amount of increase of fuel is set based on the engine rotational speed which is an indicator of the amount of air passing through the catalyst 31 and can be easily used.

The torque discontinuous change is smaller and the allowable amount of increase (the depth of rich spike) is greater about the first rich spike D1 than about the second rich spike D2 performed after the all-of-cylinders fuel cut. Accordingly, the action time period C1 of the first rich spike D1 is shortened (C1<C2) so that the recovery control can be completed in a shorter time period. Moreover, in order to suppress the torque discontinuous change resulting from the amount of increase of fuel injection, the predetermined delay time period B1 is provided before the start of the first rich spike D1, and simultaneously the ignition timing of ignition plug 20 is controlled to be retarded. The retarded amount F1 of the ignition timing is set depending on the assumed torque discontinuous change E1 as shown in FIG. 3, to suppress or cancel the torque discontinuous change E1.

At a time instant t6, the accelerator is turned off (the accelerator opening becomes zero). At a time instant t7 when a predetermined time period Δt has elapsed after a shift into vehicle decelerating condition, the fuel cut condition is satisfied and the fuel cut is restarted. Similar to the situation described above, at the fuel cut start time instant t7, the half-of-cylinders fuel cut is first performed because the estimated torque discontinuous change is out of the allowable region. At a time instant t8 when the constant time period A1 has elapsed after the fuel cut start time instant t7 without satisfaction of the fuel cut recovery condition such as the accelerator ON while the half-of-cylinders fuel cut is being performed, ECU 41 proceeds to the all-of-cylinders fuel cut. This feature of proceeding to the all-of-cylinders fuel cut in response to the lapse of the constant time period A1 after the start of the half-of-cylinders fuel cut, serves to ensure the combustion stability and suppress the occurrence of the torque discontinuous change resulting from the fuel cut.

At a time instant t9 when a constant time period A2 has elapsed after the start of the all-of-cylinders fuel cut, ECU 41 proceeds from Step S20 to Step S21 where ECU 41 performs a recovery control (normal recovery) from the all-of-cylinders fuel cut. In this recovery control, the second rich spike D2 is performed during the predetermined action time period C2 after a time instant t10 when a predetermined delay time period B2 for awaiting stabilization of combustion has elapsed after the fuel cut end time instant t9, i.e. the fuel supply restart time instant t9. The second rich spike D2 is implemented by increasing the amount of fuel supply greater than a desired value corresponding to a desired equivalence ratio so that the air fuel ratio of exhaust gas becomes richer than the theoretical air fuel ratio, similar to the first rich spike D1. The amount of increase of fuel and the action time period C2 about the second rich spike D2 are set based on the stored amount of oxygen, in conformance with the stored amount of oxygen absorbed and stored in catalyst 31. Namely, the second rich spike D2 is set so that the amount of increase increases (the degree of being rich increases) as the stored amount of oxygen increases, to reduce the residual stored amount of oxygen in catalyst 31, and thereby ensure the nominal purifying function of catalyst 31. The stored amount of oxygen can be estimated based on the output signal of air fuel ratio sensor 32 provided on the upstream side of catalyst 31 and the flow rate of exhaust gas, for example. The flow rate of exhaust gas can be estimated based on the output signal of air flow meter 25, for example.

The torque discontinuous change is greater and the allowable amount of increase (the depth of rich spike) is smaller about the second rich spike D2 than about the first rich spike D1 for the half-of-cylinders fuel cut. Accordingly, the amount of increase of the second rich spike D2 is set smaller so that the action time period C2 of the second rich spike D2 becomes longer than the action time period C1 of the first rich spike D1. Moreover, in order to suppress the torque discontinuous change resulting from the amount of increase of fuel injection, the predetermined delay time period B2 is provided before the start of the second rich spike D2, and simultaneously the ignition timing is controlled to be retarded, similar to the first rich spike D1. The retarded amount F2 of the ignition timing is set depending on the assumed torque discontinuous change E2 as shown in FIG. 3, to suppress or cancel the torque discontinuous change E2.

Although it is not shown in the example of FIG. 3, when the accelerator pedal is depressed (accelerator ON) while the all-of-cylinders fuel cut is being performed, ECU 41 proceeds from Step S18 to Step S19 where ECU 41 performs the forced recovery control. Also during the forced recovery control, a rich spike is performed similar to the second rich spike D2, wherein the amount of increase of fuel and the action period are set depending on the stored amount of oxygen in catalyst 31.

Although the delay time period B1 for the first rich spike D1 for the half-of-cylinders fuel cut and the delay time period B2 for the second rich spike D2 for the all-of-cylinders fuel cut are set equal to each other for simplification of the control in the present embodiment, it may be configured so that they are different from each other.

The following describes characterized configurations and produced effects of the present embodiment.

<1> The feature of performing a first operation of cutting off fuel supply to part of the cylinders in response to satisfaction of a predetermined fuel cut condition, and performing a second operation of cutting off fuel supply to all of the cylinders in response to a lapse of a first predetermined time period A1 after the first operation, serves to ensure the combustion stability by the part-of-cylinders fuel cut and suppress the torque discontinuous change resulting from the fuel cut by performing the all-of-cylinders fuel cut following the part-of-cylinders fuel cut. The feature of performing a third operation and a fourth operation in response to satisfaction of a first predetermined fuel cut recovery condition during the first operation, wherein the third operation is to restart fuel supply to the part of the cylinders, and the fourth operation is a first rich spike D1 to control exhaust gas to a first air fuel ratio richer than a theoretical air fuel ratio by an increased amount of fuel supply during a second predetermined time period C1 after the third operation, serves to reduce the stored amount of oxygen in catalyst 31 and thereby obtain the desired exhaust gas purifying function by performing the first rich spike D1 also in the situation where fuel supply is restarted in response to depressing operation of the accelerator pedal or the like while the fuel cut for the part of the cylinders is being performed, in contract to the case where the stored amount of oxygen absorbed and stored in catalyst 31 disposed in exhaust passage 30 is increased by the fuel cut.

<2> The feature of performing a fifth operation and a sixth operation in response to satisfaction of a second predetermined fuel cut recovery condition during the second operation, wherein the fifth operation is to restart fuel supply to all of the cylinders, and the sixth operation is a second rich spike D2 to control exhaust gas to a second air fuel ratio richer than the theoretical air fuel ratio by an increased amount of fuel supply during a third predetermined time period C2 after the fifth operation, serves to reduce the stored amount of oxygen in catalyst 31 and thereby obtain the desired exhaust gas purifying function by performing the second rich spike D2 also in the situation where fuel supply is restarted in response to depressing operation of the accelerator pedal or the like while the fuel cut for all of the cylinder is being performed.

<3> Preferably, the feature of setting the first air fuel ratio at the first rich spike D1 performed when fuel supply is restarted from the condition where the part-of-cylinders fuel cut is being performed and the second air fuel ratio at the second rich spike D2 performed when fuel supply is restarted from the condition where the all-of-cylinders fuel cut is being performed different in degree of being rich in consideration of torque discontinuous change and others, serves to suppress the torque discontinuous change and shorten the period when the first rich spike D1 is performed.

<4> Specifically, it sets the first air fuel ratio at the first rich spike D1 performed when fuel supply is restarted from the condition where the part-of-cylinders fuel cut is being performed higher in degree of being rich than the second air fuel ratio at the second rich spike D2 performed when fuel supply is restarted from the condition where the all-of-cylinders fuel cut is being performed. This feature serves to shorten the action time period C1 of the first rich spike D1 and thereby terminate the first rich spike D1 soon by increasing the amount of increase of fuel of the first rich spike D1 and thereby increasing the degree of being rich, in the case of the part-of-cylinders fuel cut where the torque discontinuous change is small, as compared to the case of the all-of-cylinders fuel cut.

<5> Namely, it sets the second predetermined time period, which serves to make the air fuel ratio of exhaust gas rich when fuel supply is restarted from the condition where the part-of-cylinders fuel cut is being performed, i.e. the action time period C1 of the first rich spike D1, shorter than the third predetermined time period, which serves to make the air fuel ratio of exhaust gas rich when fuel supply is restarted from the condition where the all-of-cylinders fuel cut is being performed, i.e. the action time period C2 of the second rich spike D2. This feature serves to shorten the action time period C1 of the first rich spike D1 and thereby terminate the first rich spike D1 soon while suppressing the torque discontinuous change, similar to <4>.

<6> It controls an ignition timing of an ignition plug 20 to be retarded by a predetermined retarded amount F1 from a normal ignition timing, simultaneously with the fourth operation of controlling exhaust gas to the first air fuel ratio richer than the theoretical air fuel ratio by the first rich spike D1 when fuel supply is restarted from the condition where the part-of-cylinders fuel cut is being performed. The retarded amount F1 of the ignition timing is set to suppress the torque discontinuous change E1 resulting from the restart of fuel supply, so that the retarded amount F1 increases with an increase of the engine rotational speed, with an increase of the stored amount of oxygen of catalyst 31, and with an increase of the degree of being rich. The retarding the ignition timing with the restart of fuel supply serves to sufficiently suppress the torque discontinuous change E1 resulting from the restart of fuel supply.

<7> In addition to <6>, it controls the ignition timing of the ignition plug 20 to be retarded by a second predetermined retarded amount F2 from the normal ignition timing, simultaneously with the sixth operation of controlling exhaust gas to a second air fuel ratio richer than the theoretical air fuel ratio by the second rich spike D2 when fuel supply is restarted from the condition where the all-of-cylinders fuel cut is being performed. Moreover, it sets the first predetermined retarded amount F1 and the second predetermined retarded amount F2 different from each other. Namely, the retarded amount F1 and retarded amount F2 of ignition timing are set individually based on the torque discontinuous changes E1, E2, for suitably suppressing the torque discontinuous changes caused by the restart of fuel supply. This serves to suppress the torque discontinuous change E1, E2 suitably depending on individual conditions, both in the case of restart from the part-of-cylinders fuel cut and in the case of restart from the all-of-cylinders fuel cut.

<8> Specifically, it is preferable that the first predetermined retarded amount F1 is smaller than the second predetermined retarded amount F2, because the torque discontinuous change is smaller in the case of restart from the part-of-cylinders fuel cut as compared to the case of restart from the all-of-cylinders fuel cut, and the torque discontinuous change is larger in the case of restart from the condition where fuel is cut off to all of the cylinders (F1<F2).

<9> The feature of performing the fourth operation of start of the first rich spike D1 in response to a lapse of a predetermined delay period B1 after the third operation of restart of fuel supply from the condition of the part-of-cylinders fuel cut, serves to ensure the combustion stability at the time of restart of fuel supply from the fuel cut, and suppress the occurrence of a rapid torque discontinuous change.

<10> In addition to <9>, the feature of performing the sixth operation of start of the second rich spike at rich spike start time instant t10 in response to a lapse of a second predetermined delay period B2 after the fifth operation of restart of fuel supply from the condition of the all-of-cylinders fuel cut at the fuel supply restart time instant t9, serves to ensure the combustion stability at the time of restart of fuel supply from the fuel cut, and suppress the occurrence of a rapid torque discontinuous change.

In the present embodiment, although the delay time period B1 for the restart of fuel supply from the condition of the part-of-cylinders fuel cut and the delay time period B2 for restart of fuel supply from the condition of the all-of-cylinders fuel cut are set equal to each other for simplification of the control in the present embodiment, it may be configured so that they are different from each other to suppress the torque discontinuous change more effectively.

<11> Specifically, the feature of setting the first predetermined delay period B1 for the restart of fuel supply from the condition of the part-of-cylinders fuel cut shorter than the second predetermined delay period B2 for restart of fuel supply from the condition of the all-of-cylinders fuel cut in consideration that the torque discontinuous change is smaller at the recovery from the part-of-cylinders fuel cut, serves to suppress the occurrence of a torque discontinuous change and shorten the predetermined delay time period B1 for the restart of fuel supply from the condition where fuel supply is cut about the part of the cylinders.

<12> It performs the second operation of the all-of-cylinders fuel cut without the first operation of the part-of-cylinders fuel cut by proceeding from Step S12 to Step S17 in FIG. 2 in response to simultaneous satisfaction of the predetermined fuel cut condition and a predetermined all cylinder fuel cut condition. This serves to perform the all-of-cylinders fuel cut without the part-of-cylinders fuel cut and thereby terminate the fuel cut soon with suppressing the torque discontinuous change, when the engine load immediately before the fuel cut condition is satisfied is low so that the caused torque discontinuous change is small.

The invention claimed is:

1. An internal combustion engine fuel cut control device for an internal combustion engine including a plurality of cylinders, wherein the internal combustion engine fuel cut control device performs the following:

performing a first operation and/or a second operation, wherein the first operation is to cut off fuel supply to part of the cylinders, and the second operation is to cut off fuel supply to all of the cylinders;

when performing both the first and second operations, performing the first operation in response to satisfaction of a predetermined fuel cut condition, and performing the second operation in response to a lapse of a first predetermined time period after the first operation;

when performing the first operation, performing a third operation and a fourth operation in response to satisfaction of a first predetermined fuel cut recovery condition during the first operation, wherein the third operation is to restart fuel supply to the part of the cylinders, and the fourth operation is to control exhaust gas to a first air fuel ratio richer than a theoretical air fuel ratio by an increased amount of fuel supply during a second predetermined time period after the third operation;

when performing the second operation, performing a fifth operation and a sixth operation in response to satisfaction of a second predetermined fuel cut recovery condition during the second operation, wherein the fifth operation is to restart fuel supply to all of the cylinders, and the sixth operation is to control exhaust gas to a second air fuel ratio richer than the theoretical air fuel ratio by an increased amount of fuel supply during a third predetermined time period after the fifth operation; and setting the first air fuel ratio higher in degree of being rich than the second air fuel ratio.

2. The internal combustion engine fuel cut control device as claimed in claim 1, wherein the internal combustion engine fuel cut control device sets the second predetermined time period shorter than the third predetermined time period.

3. The internal combustion engine fuel cut control device as claimed in claim 1, wherein the internal combustion engine fuel cut control device controls an ignition timing of an ignition plug to be retarded by a predetermined retarded amount from a normal ignition timing, simultaneously with the fourth operation.

4. The internal combustion engine fuel cut control device as claimed in claim 3:

wherein the internal combustion engine fuel cut control device controls the ignition timing of the ignition plug to be retarded by a second predetermined retarded amount from the normal ignition timing, simultaneously with the sixth operation; and wherein the internal combustion engine fuel cut control device sets the first predetermined retarded amount and the second predetermined retarded amount different from each other.

5. The internal combustion engine fuel cut control device as claimed in claim 4, wherein the internal combustion engine fuel cut control device sets the first predetermined retarded amount smaller than the second predetermined retarded amount.

6. The internal combustion engine fuel cut control device as claimed in claim 1, wherein the internal combustion engine fuel cut control device performs the fourth operation in response to a lapse of a predetermined delay period after the third operation.

7. The internal combustion engine fuel cut control device as claimed in claim 6:

wherein the internal combustion engine fuel cut control device performs the fourth operation in response to a lapse of a first predetermined delay period after the third operation;

wherein the internal combustion engine fuel cut control device performs the sixth operation in response to a lapse of a second predetermined delay period after the fifth operation; and wherein the internal combustion engine fuel cut control device sets the first predetermined delay period and the second predetermined delay period different from each other.

8. The internal combustion engine fuel cut control device as claimed in claim 7, wherein the internal combustion engine fuel cut control device sets the first predetermined delay period shorter than the second predetermined delay period.

9. The internal combustion engine fuel cut control device as claimed in claim 1, wherein the internal combustion engine fuel cut control device performs the second operation without the first operation in response to simultaneous satisfaction of the predetermined fuel cut condition and a predetermined all cylinder fuel cut condition.

10. An internal combustion engine fuel cut control method for an internal combustion engine including a plurality of cylinders, wherein the internal combustion engine fuel cut control method comprising:

performing a first operation and/or a second operation, wherein the first operation is to cut off fuel supply to part of the cylinders, and the second operation is to cut off fuel supply to all of the cylinders;

when performing both the first and second operations, performing a first operation in response to satisfaction of a predetermined fuel cut condition, and performing a second operation in response to a lapse of a first predetermined time period after the first operation;

when performing the first operation, performing a third operation and a fourth operation in response to satisfaction of a first predetermined fuel cut recovery condition during the first operation, wherein the third operation is to restart fuel supply to the part of the cylinders, and the fourth operation is to control exhaust gas to a first air fuel ratio richer than a theoretical air fuel ratio by an increased amount of fuel supply during a second predetermined time period after the third operation;

when performing the second operation, performing a fifth operation and a sixth operation in response to satisfaction of a second predetermined fuel cut recovery condition during the second operation, wherein the fifth operation is to restart fuel supply to all of the cylinders, and the sixth operation is to control exhaust gas to a second air fuel ratio richer than the theoretical air fuel ratio by an increased amount of fuel supply during a third predetermined time period after the fifth operation; and setting the first air fuel ratio higher in degree of being rich than the second air fuel ratio.

* * * * *